US008348709B1

(12) United States Patent
Passman et al.

(10) Patent No.: US 8,348,709 B1
(45) Date of Patent: Jan. 8, 2013

(54) METHOD OF MAKING A SPARK PLUG

(75) Inventors: Eric Passman, Piscataway, NJ (US); Martin Carlin Baker, Budd Lake, NJ (US); Jeffrey Boehler, Holland, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/315,886

(22) Filed: Dec. 9, 2011

(51) Int. Cl.
*H01J 9/00* (2006.01)

(52) U.S. Cl. ..... 445/7

(58) Field of Classification Search ..... None
See application file for complete search history.

(56) References Cited

U.S. PATENT DOCUMENTS

| | | | | |
|---|---|---|---|---|
| 7,719,172 | B2 * | 5/2010 | Boehler et al. | 313/141 |
| 2008/0018217 | A1 * | 1/2008 | Boehler et al. | 313/141 |
| 2009/0127996 | A1 * | 5/2009 | Passman et al. | 313/136 |
| 2011/0127900 | A1 * | 6/2011 | Ma et al. | 313/141 |
| 2012/0001533 | A1 * | 1/2012 | Sakayanagi et al. | 313/141 |
| 2012/0126682 | A1 * | 5/2012 | Walker, Jr. | 313/141 |

* cited by examiner

*Primary Examiner* — Ashok Patel
(74) *Attorney, Agent, or Firm* — Barnes & Thornburg LLP

(57) ABSTRACT

A method of making a spark plug includes providing a metal shell, an insulator at least partially disposed in the metal shell, a ground electrode coupled to the metal shell, and a center electrode disposed within the insulator. The method also includes depositing a tip substance on the spark plug to form an electrode tip.

19 Claims, 2 Drawing Sheets

METHOD OF MAKING A SPARK PLUG

BACKGROUND OF THE INVENTION

The subject matter disclosed herein relates to a spark plug for use with an internal combustion engine, and more particularly to a method of making a spark plug using a laser device.

Spark plugs are typically manufactured, in part, by laser welding a metal electrode to a center wire and side wire of the spark plug. The alloys are often alloyed, turned into wire form, then cut and processed into cylinders, balls, rivets, or other components, prior to welding to the center wire and/or side wire. Such a method undesirably requires two major operational steps and includes drawbacks associated with welding inefficiency. It also limits use to the metal alloys that are weldable and can be drawn into wire and/or formed into other shapes.

Accordingly, while existing methods of fabricating a spark plug are suitable for their intended purpose, the need for improvement remains, particularly in the fabrication of the electrode tip.

BRIEF DESCRIPTION OF THE INVENTION

According to one aspect of the invention, a method of making a spark plug includes providing a metal shell, an insulator at least partially disposed in the metal shell, a ground electrode coupled to the metal shell, and a center electrode disposed within the insulator. The method also includes depositing a tip substance on the spark plug to form an electrode tip.

According to another aspect of the invention, a method of making a spark plug includes providing a metal shell, an insulator at least partially disposed in the metal shell, a ground electrode coupled to the metal shell, and a center electrode disposed within the insulator. The method also includes laser depositing a tip substance on the center electrode proximate a tip end. The method further includes melting the tip substance to form an electrode tip, wherein the step of depositing the tip substance and the step of melting the tip substance are performed in conjunction.

According to yet another aspect of the invention, a spark plug includes a metal shell having a bore extending axially therethrough. The spark plug also includes an insulator at least partially disposed in the metal shell, the insulator having a first end, the insulator having a center axis. Further included is a ground electrode coupled to the metal shell, wherein the ground electrode includes a ground electrode tip operably coupled to the ground electrode. Yet further included is a center electrode disposed substantially within the insulator and having a tip end extending from the first end of the insulator. Also included is a center electrode tip comprising at least one noble metal, wherein the tip material is deposited as a powder and melted by a coherent laser light to form the tip end of the center electrode.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
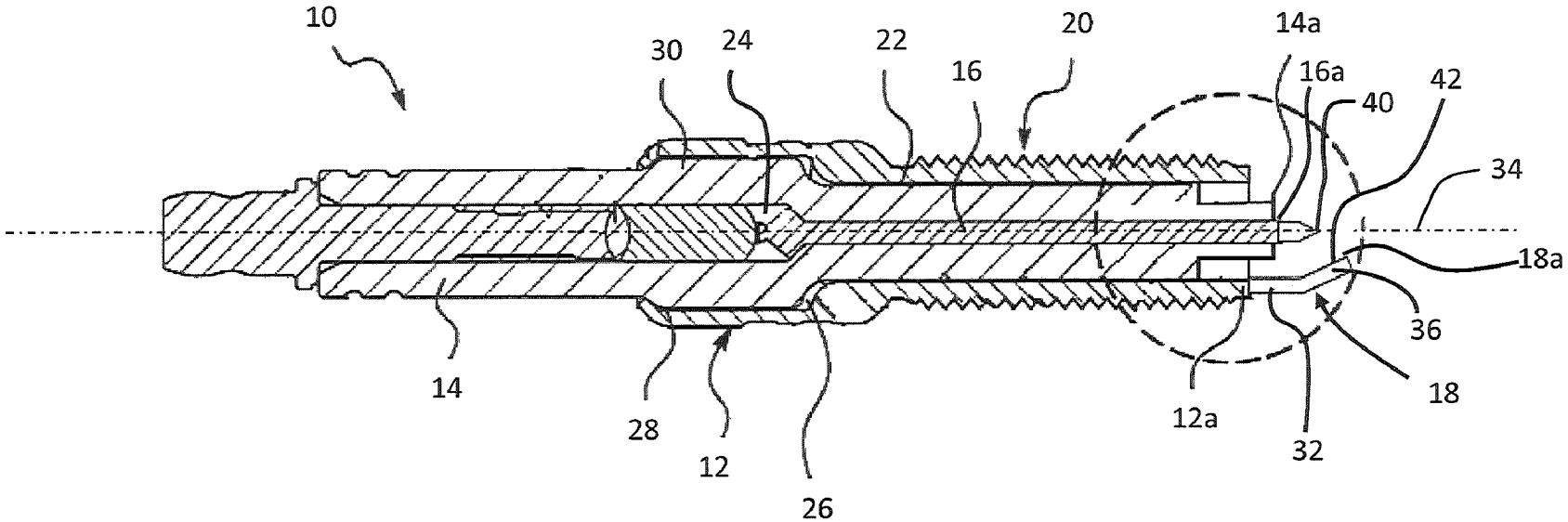
FIG. 1 is a side, elevational view of a spark plug.

Referring to FIG. 1, a spark plug generally indicated by the reference numeral 10 is illustrated and is designed for use in an internal combustion engine of an automobile vehicle. The installation of the spark plug 10 into an internal combustion engine is achieved by fitting it so that it protrudes into a combustion chamber through a threaded bore provided in the engine head (not shown).

The spark plug 10 includes a tube-shaped metal shell 12, an insulator 14, a center electrode 16 and a ground electrode 18. The ground electrode 18 is coupled to the metal shell 12 on the combustion chamber side of the spark plug 10.

The metal shell 12 is made from a conductive metal material such as steel for example. The metal shell 12 has a threaded shank portion 20 on the outer periphery. The threaded portion 20 cooperates with a thread in the engine head to couple the spark plug 10 to the engine. The metal shell 12 also includes a shell axial bore 22 that extends along its length.

The insulator 14 is an elongated component that is at least partially disposed within the shell axial bore 22. The insulator 14 may be made from a nonconducting ceramic material such as, but not limited to, alumina ceramic, for example. This arrangement allows the center electrode 16 to be retained within the insulator 14 while preventing an electrical conductive path from forming between the center electrode 16 and the metal shell 12. The insulator 14 is coupled to the metal shell 12 such that an end 14*a* of the insulator 14 protrudes from an end 12*a* of the metal shell 12. The insulator 14 includes an insulator axial bore 24 that extends through the insulator 14 and is sized to fit the center electrode 16. The insulator 14 may also include exterior shoulders 26, 28 arranged at either end of an expanded flange portion 30.

The center electrode 16 is made from a solid or clad material. The core material may have cladding that is made from a heat resistant, corrosion-resistant metal material such as, but not limited to, a solid nickel alloy or Inconel, for example. The center electrode 16 may also be made from a nickel based alloy without having a separate core and cladding component. The center electrode 16 is secured in the insulator axial bore 24 such that it is electrically isolated from the metal shell 12. The center electrode 16 has an end 16*a* that is arranged to protrude beyond the end 14*a* of insulator 14. The end 16*a* may take on a number of configurations, including but not limited to a cylindrical body, terminating in a flat, blunt face, or alternatively various other shapes, such as a conical end, for example.

The ground electrode 18 is coupled to the metal shell 12 on the end 12*a*. The ground electrode 18 may be made from an electrically conductive metal material, such as a nickel based material, for example. The ground electrode 18 may take on various configurations, including a substantially linearly aligned first segment 32 that is aligned substantially parallel to a center axis 34. Alternatively, and as illustrated, the ground electrode 18 may be configured as a substantially J-shaped member that comprises the first segment 32 that extends from the metal shell 12 and a second portion 36 that is arranged on an angle relative to the center axis 34. The second portion 36 may be disposed at any number of angles relative to the center axis 34. The angle is typically between 0 and 90 degrees, relative to the center axis 34. In the extreme case of 0 degrees, the ground electrode 18 takes on the embodiment described above, that being substantially linear and parallel to the center axis 34. In the other extreme case of 90 degrees, the ground electrode 18 is substantially perpendicular to the center axis 34 and extends radially inward to a position proximate the end 16*a* of the center electrode 16.

The center electrode 16 includes a center electrode tip 40 proximate the end 16*a*. Similarly, the ground electrode 18 includes a ground electrode tip 42 proximate the end 18*a*. The respective tip members 40, 42 cooperate to form a spark gap. One or both of the tip members 40, 42 may be formed of one or more noble metals. Such noble metals may include platinum, nickel, iridium, tungsten, palladium, and rhodium, or any combination thereof. These materials are merely examples of suitable metals that may be employed to form the center electrode tip 40 and/or ground electrode tip 42, and one may substitute alternative metals. The noble metals may initially be in the form of a powder prior to formation and engagement with the center electrode 16 and/or ground electrode 18.

A method for making the spark plug 10 includes providing spark plug components and elements previously described and assembled in a known manner. Typically after the center electrode 16 is coupled to the insulator 14, and the insulator 14 to the metal shell 12, the center electrode tip 40 is operably coupled to the end 16*a* of the center electrode 16. Similarly, the ground electrode tip 42 is operably coupled to the end 18*a* of the ground electrode 18. Regardless of which tip 40, 42 is being applied to the spark plug 10, the method provides a user the ability to form the tip 40, 42 and secure it to the respective electrode 16, 18. The tip 40 may be circularly shaped and built into a cylinder, but, various other shapes may also be possible by varying the laser and metal deposition parameters.

Figure 2:
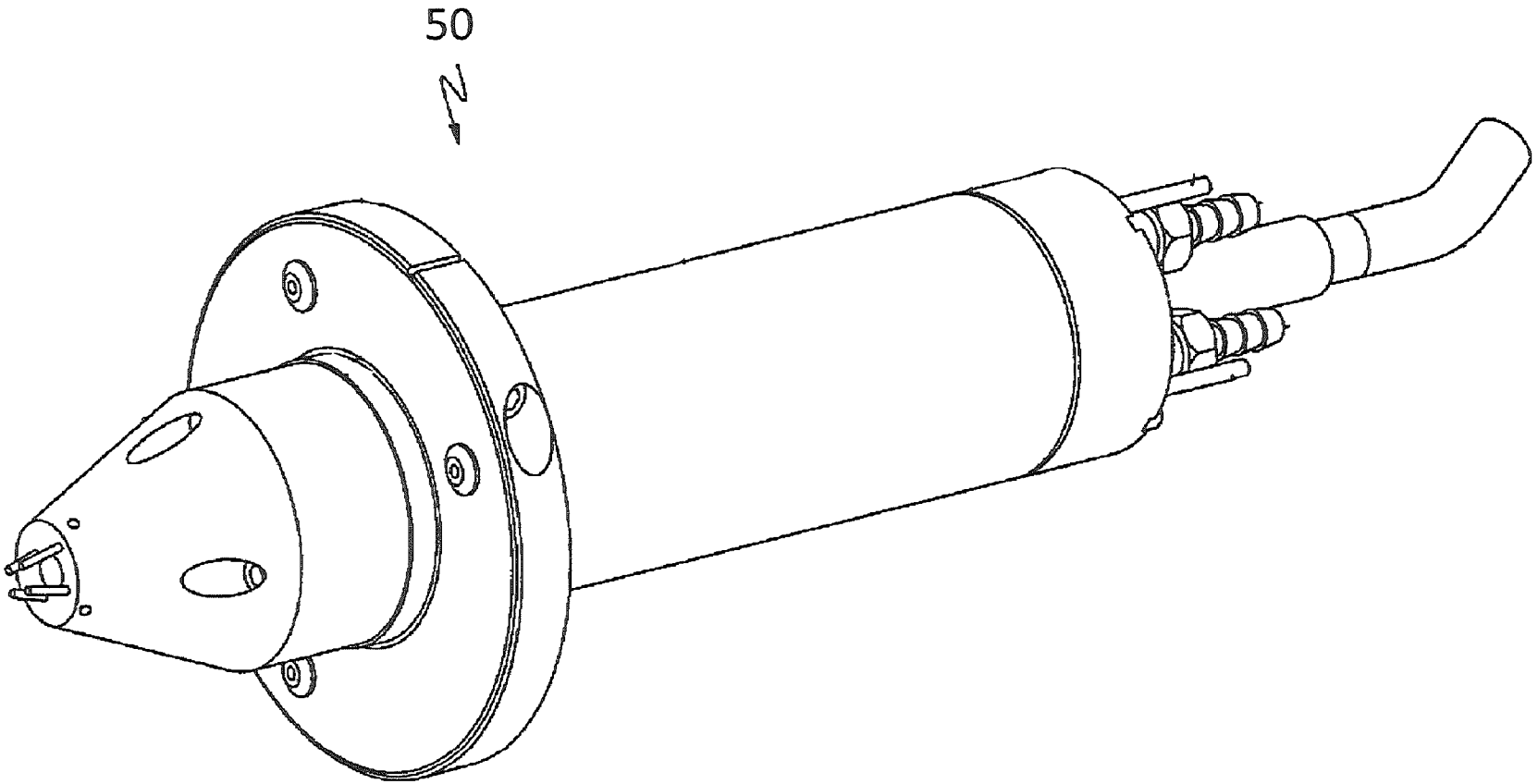
FIG. 2 is a perspective view of a hand-held laser welding device.

Referring to FIG. 2, a hand-held laser welding wand 50 is illustrated and provides an assembly operator an ability to form the tip 40 and secure it to the center electrode 16. An example of such a wand 50 is disclosed in U.S. Pat. No. 7,030,337, the entire disclosure of which is incorporated by reference herein. Although illustrated as a hand-held laser welding wand 50, it is contemplated that an automated device comprising some of the features of the wand 50 would be employed to form the tip 40 in the manner disclosed herein. Such an automated device would be robotically controlled and manipulated. The wand 50 is capable of depositing various media, including one or more noble metals in powder or wire form onto the end 16*a* of the center electrode 16, melting the powders to form a suitable alloy with the coherent light of the laser, then laser welding the alloy to the center electrode 16, thereby forming and securing the center electrode tip 40. The aforementioned steps may be performed in a single operation, advantageously alleviating the need to separately form the center electrode tip 40, then welding the center electrode tip 40 to the end 16*a* of the center electrode 16 in separate operational steps.

Operational parameters, such as time and temperature would depend on the selection of electrode base metal and noble metal. As an example, the melting temperature of pure Nickel is 1453° C. A laser power density (Watts/unit area) must be sufficient to melt the electrode metal and the noble metal powder simultaneously. This is a function of the physical characteristics of the host metals, including mass and thermal properties, light absorption properties, the laser beam area at the focus, laser beam power and process time. The typical time needed to affect a weld would be in the range of 200 milliseconds to 1 second, but shorter or longer times may be possible. A wavelength of approximately 1 micrometer based on Nd:Yag may be employed. However, other wavelengths in the near infrared and infrared may also be used, such as $CO^2$ lasers at 10 micrometers, for example. A typical powder flow rate may range from 10 milligrams per second to 100 milligrams per second. The thickness of the center electrode tip 40 may be selectively controlled by the application duration of the laser depositing step. Such customization provides design flexibility while fusing the center electrode tip 40 with the end 16*a* with the laser.

As previously described, the method may be employed to form and secure a ground electrode tip 42 as well. Additionally, it is contemplated that direct deposition of the noble metal materials may be performed to coat an edge of the center electrode 16 for use in a side-firing spark plug. Such an application may include the step of rotating the center electrode 16 while in the stream of the laser material deposition process.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of making a spark plug comprising:

providing a metal shell; an insulator at least partially disposed in the metal shell; a ground electrode coupled to the metal shell; and a center electrode disposed within the insulator; and depositing a tip substance on the spark plug, melting the tip substance, and laser deposition welding the tip substance to the spark plug to form an electrode tip, wherein the steps of depositing the tip substance, melting the tip substance, and laser deposition welding the tip substance to the spark plug are performed in a single operation.

2. The method of making a spark plug of claim 1, wherein the tip substance comprises a powder mixture of individual metals.

3. The method of making a spark plug of claim 2, wherein the step of melting the tip substance forms an alloy material.

4. The method of making a spark plug of claim 1, wherein the step of melting the tip substance is performed using coherent light.

5. The method of making a spark plug of claim 1, wherein the step of depositing the tip substance on the spark plug comprises depositing the tip substance on the center electrode to form a center electrode tip.

6. The method of making a spark plug of claim 5, wherein the step of depositing the tip substance on the spark plug further comprises depositing the tip substance on the ground electrode to form a ground electrode tip proximate the center electrode tip, thereby forming a spark gap.

7. The method of making a spark plug of claim 1, wherein the tip substance comprises a noble metal or noble metal combination.

8. The method of making a spark plug of claim 7, wherein the noble metal combination comprises platinum and nickel.

9. The method of making a spark plug of claim 7, wherein the noble metal combination comprises platinum, iridium and tungsten.

10. The method of making a spark plug of claim 7, wherein the noble metal combination comprises platinum, palladium and iridium.

11. The method of making a spark plug of claim 7, wherein the noble metal combination comprises iridium and rhodium.

12. The method of making a spark plug of claim 7, wherein the noble metal combination comprises platinum and rhodium.

13. A method of making a spark plug comprising:

providing a metal shell; an insulator at least partially disposed in the metal shell; a ground electrode coupled to the metal shell; and a center electrode disposed within the insulator;

laser depositing a tip substance on the center electrode; and melting the tip substance to form an electrode tip, wherein the step of depositing the tip substance and the step of melting the tip substance are performed in a single operation.

14. The method of making a spark plug of claim 13, wherein the tip substance comprises a powder mixture of individual metals.

15. The method of making a spark plug of claim 13, wherein the tip substance comprises a noble metal or noble metal combination.

16. The method of making a spark plug of claim 15, wherein the noble metal combination comprises platinum and nickel.

17. The method of making a spark plug of claim 15, wherein the noble metal combination comprises platinum, iridium and tungsten.

18. The method of making a spark plug of claim 15, wherein the noble metal combination comprises platinum, palladium and iridium.

19. The method of making a spark plug of claim 15, wherein the noble metal combination comprises iridium and rhodium.

* * * * *